United States Patent [19]

Leahy et al.

[11] 4,233,876

[45] Nov. 18, 1980

[54] METHOD FOR PREVENTING FREEZE-UP OF MUSICAL INSTRUMENT VALVES AND OTHER MOVABLE ELEMENTS

[76] Inventors: Thomas Leahy, Box 269C, R.R. 1, Breese, Ill. 62230; John Fenoli, P.O. Box 49, Aviston, Ill. 62216

[21] Appl. No.: 928,356

[22] Filed: Jul. 27, 1978

[51] Int. Cl.[3] ..... G10D 9/04; C10M 1/22

[52] U.S. Cl. ..... 84/388; 252/49.3; 252/52 R; 252/73

[58] Field of Search ..... 252/49.3, 52 R, 73; 84/388

[56] References Cited

U.S. PATENT DOCUMENTS

| | | | |
|---|---|---|---|
| 2,060,110 | 11/1936 | Paxton | 252/73 |
| 2,102,506 | 12/1937 | Bland | 252/73 X |
| 3,000,826 | 9/1961 | Gillilland | 252/49.3 |
| 3,171,812 | 3/1965 | Horth et al. | 252/49.3 X |
| 3,374,171 | 3/1968 | Davis | 252/49.3 X |
| 3,630,898 | 12/1971 | Tetter et al. | 252/49.3 X |
| 3,755,168 | 8/1973 | Mixon et al. | 252/49.3 X |
| 3,847,828 | 11/1974 | Latos | 252/49.3 X |
| 3,925,216 | 12/1975 | Moorhouse | 252/49.3 |
| 4,073,736 | 2/1978 | Schick et al. | 252/52 R X |

FOREIGN PATENT DOCUMENTS

| | | | |
|---|---|---|---|
| 1444903 | 11/1968 | Fed. Rep. of Germany | 252/49.3 |
| 721526 | 1/1955 | United Kingdom | 252/49.3 |
| 995708 | 6/1965 | United Kingdom | 252/49.3 |
| 420655 | 2/1972 | U.S.S.R. | 252/49.3 |

*Primary Examiner*—Thomas A. Waltz

*Attorney, Agent, or Firm*—Gravely, Lieder & Woodruff

[57] ABSTRACT

A method and composition of preventing the valves and slides of musical instruments from sticking or becoming sluggish at low temperatures. The method involves the application of a solution comprising a polyhydric alcohol, a monohydric alcohol, and water to movable parts. The method and composition may also be used to lubricate the valves and slides of the instruments and other movable elements.

5 Claims, No Drawings

METHOD FOR PREVENTING FREEZE-UP OF MUSICAL INSTRUMENT VALVES AND OTHER MOVABLE ELEMENTS

BACKGROUND OF THE INVENTION

The present invention relates to a method for preventing the freezing of movable elements in musical instruments in low temperature environments. The movable elements contemplated are those which form the moving parts of brass musical instruments.

In cold weather, the valves of all brass instruments, such as trumpets, French horns, etc. and of sliding instruments, such as the trombone, tend to stick, or "lock-up", due to the freezing of the moisture from the musician's breath. Lock-up brings about obvious detrimental effects, particularly with the brass sections in marching bands.

The problem of lock-up is particularly acute with large instruments such as the Sousaphone or Baritone because moisture present in the breath travels a greater distance, and thus has a longer period of time to cool and freeze.

At the present time, musicians apply achohol on the instrument valves. Herco Company, Conn Company and Selmer Company manufacture a lubricating oil for suppressing the "lock-up" of musical instrument valves, but the oil is not effective at low temperatures.

Accordingly, it is an object of this invention to provide a means for preventing "lock-up" caused by cold weather.

It is a further object to provide a means for lubricating the valves and slides of brass and other musical instruments and other movable elements.

It is still a further object to provide these means for preventing "lock-up" and for lubrication without resulting in any harmful side effects on the users of the instruments or the instruments themselves.

SUMMARY OF THE INVENTION

This invention involves a method and composition for preventing "lock-up" of the valves and sliding parts of musical instruments and other movable elements. "Lock-up" is caused by freezing of moisture at low temperatures below about 32° F. The method calls for the application of a solution of a polyhydric alcohol, monohydric alcohol, and water to the moving parts of the instruments. The solution may also be used to lubricate the valves and slides of the instrument and other movable elements.

DETAILED DESCRIPTION

Musical wind instruments accumulate moisture from the breath of the musicians. If the instruments are used in a low temperature (less than 32° F.) environment, this moisture will freeze on various parts of the instrument, including the moving parts such as the valves and slides of brass instruments. As a result of this freezing, the moving parts will become sluggish and/or frozen, thus making these parts inoperable. This freezing phenomenon may occur to be a somewhat lesser extent in woodwind instruments.

To alleviate the problem caused by freezing, a lubricating composition has been formulated for application to the moving parts likely to be affected. The lubricating composition should be applied to the valves and/or slides. Suitable methods of application include spraying, dropping by means of a dropper, and atomizing. The composition can be applied at temperatures ranging from −10° F. to 110° F. The composition is most likely to be used at 0° F. to 32° F.

The composition to be applied to the movable brass elements comprises a polyhydric alcohol, preferably glycerol, a monohydric alcohol, preferably ethanol, and water.

The glycerol (chemical formula $C_3H_5(OH)_3$), can be a technical grade glycerol or an analytical reagent. The ethanol (chemical formula: $C_2H_5OH$), should be technical grade, and denatured to avoid consumption.

The concentration of the polyhydric alcohol should range from about 27% to about 37%; the concentration of the monohydric alcohol should range from about 43% to about 53%; the concentration of water should range from about 18% to about 22%. These concentrations are on a volume basis. Glycerol has a freezing point of 18.6° C. Ethanol has a freezing point of −117.3° C. Water has a freezing point of 0° C. Suitable substitutes for glycerol include ethylene glycol, proplylene glycol, and any one of the butylene glycols. However, glycerol is the preferred polyhydric alcohol. Methanol is unsuitable as a substitute for ethanol because it may result in blindness if ingested. Isopropyl alcohol is unsuitable as a substitute for ethanol because it may result in nausea if ingested.

Table I shows the test results on a baritone horn and $B^b$ cornet. The instruments were manufactured by The Conn Instrument Company. Each instrument was placed in a walk-in freezer which was held at the temperature specified. The instrument was then removed from the freezer after the duration specified. Prior to adding the solution to the valves, the instrument was "locked-up". After the specified amount of solution was applied, the instrument could be operated satisfactorily. The solution was applied by means of a dropper.

TABLE I

| Instrument | Temperature of room in which instrument was cooled (F.°) | Time Instrument was cooled (min) | Characteristics of operation of instrument without solution | Amount of solution employed (ml) | Characteristic of operation of instrument with solution |
|---|---|---|---|---|---|
| Baritone | 14 | 10 | Locked-up | ¼ ml per valve | one valve sluggish |
| Baritone | 14 | 10 | Locked-up | ¼ ml per valve | satisfactory |
| Baritone | 25 | 10 | Locked-up | ¼ ml per valve | satisfactory |
| Baritone | 26 | 13 | Locked-up | ¼ ml per valve | satisfactory |
| Cornet | −4 | 11 | Locked-up | ¼ ml[1] per valve | satisfactory |
| Cornet | −2 | 15 | Locked-up | ¼ ml[1] per valve | satisfactory |
| Cornet | −6 | 2 | Locked-up | ¼ ml[1] per valve | satisfactory |

[1]The solution was reapplied until the instrument operated satisfactorily.

What is claimed is:

1. A method of lubricating movable valve elements in brass, woodwind, and similar musical instruments and for preventing said elements from sticking or becoming sluggish when the temperature falls below 32° F. by applying a solution comprising by volume about 27% to about 37% polyhydric alcohol, about 43% to about 53% monohydric alcohol, and about 18% to about 22% water to said elements.

2. The method of claim 1 wherein the solution is applied in the form of spray.

3. The method of claim 1 wherein the solution is applied in the form of drops by means of a dropper.

4. The method of claim 1 wherein the polyhydric alcohol is selected from the group consisting of glycerol, propylene glycol, ethylene glycol, and butylene glycol.

5. The method of claim 1 wherein the monohydric alcohol is ethanol.

* * * * *